US011135123B2

(12) United States Patent
Alberti

(10) Patent No.: US 11,135,123 B2
(45) Date of Patent: Oct. 5, 2021

(54) EXOSKELETAL BODY SUPPORT SYSTEM

(71) Applicant: Dorian Hunter Alberti, Madison, FL (US)

(72) Inventor: Dorian Hunter Alberti, Madison, FL (US)

( * ) Notice: Subject to any disclaimer, the term of this patent is extended or adjusted under 35 U.S.C. 154(b) by 0 days.

(21) Appl. No.: 17/129,224

(22) Filed: Dec. 21, 2020

(65) Prior Publication Data

US 2021/0228431 A1 Jul. 29, 2021

Related U.S. Application Data

(60) Provisional application No. 62/965,961, filed on Jan. 26, 2020.

(51) Int. Cl.
*A61H 3/00* (2006.01)
*A61H 1/02* (2006.01)

(52) U.S. Cl.
CPC ..... *A61H 3/00* (2013.01); *A61H 1/0262* (2013.01); *A61H 1/0292* (2013.01); *A61H 2003/007* (2013.01); *A61H 2201/1253* (2013.01); *A61H 2201/1626* (2013.01); *A61H 2201/1642* (2013.01); *A61H 2201/1652* (2013.01)

(58) Field of Classification Search
CPC ..... A61H 3/00; A61H 1/0262; A61H 1/0292; A61H 2201/1626; A61H 2201/1253; A61H 2201/1652; A61H 2003/007; A61H 2201/1642; A61H 1/0237; A61H 1/024; A61H 1/0244; A61H 1/0255; A61H 2205/08; A61H 2205/081; A61H 2205/088; A61H 2205/10; A61H 2205/102; A61H 2205/106; A61H 2205/108; A61H 2203/0406
See application file for complete search history.

(56) References Cited

U.S. PATENT DOCUMENTS

| | | | | |
|---|---|---|---|---|
| 2015/0025423 | A1* | 1/2015 | Caires | A61H 3/00 601/35 |
| 2018/0161188 | A1* | 6/2018 | Zistatsis | A61H 3/008 |
| 2018/0200878 | A1* | 7/2018 | Tsai | A61H 3/00 |
| 2018/0303699 | A1* | 10/2018 | Romo | A61H 1/0281 |
| 2018/0338883 | A1* | 11/2018 | Chavarria | A61H 1/0244 |

* cited by examiner

*Primary Examiner* — Quang D Thanh
(74) *Attorney, Agent, or Firm* — Cygnet IP Law, P.A.; Stephen W. Aycock, II

(57) ABSTRACT

Some implementations can include a mechanical passive exoskeleton for the support, endurance, and physical health of laboring workers, operators with reduced strength in extremities, and operators in need of assist when rising to a standing position. The exoskeleton can assist in bending, crouching, lifting, and other repetitive motions via resistance within the flex chain and flex cartridge assemblies and lumbar support from the resistive nested spinal assembly.

20 Claims, 12 Drawing Sheets

700

700

EXOSKELETAL BODY SUPPORT SYSTEM

RELATED APPLICATIONS

This application claims the benefit of U.S. Provisional Application No. 62/965,961, entitled "Lumbar Relief Analog Exoskeleton, L.R.A.E." and filed on Jan. 26, 2020, which is incorporated herein by reference in its entirety.

TECHNICAL FIELD

Some implementations relate to exoskeletons, and, in particular, to exoskeletal body support systems.

BACKGROUND

Some conventional exoskeletons utilize electronic, hydraulic, and pneumatic actuators to deliver an assistive force to the wearer (or user). Some conventional exoskeletons may be expensive to the manufacturer and consumer. Traditional braces may only temporarily support the user's strained bodily areas where the brace is applied but may not assist the strained movement.

The disclosed subject matter was conceived in light of the above limitations, among other things.

SUMMARY

Some implementations can include torsion springs or flexible cartridges to aid in symmetric lifting and posture retention of a wearer through the noninvasive "active brace," which normalizes operator movement and encourages return to standing rest position.

The Lifting Assistance Analog Exoskeleton is built as an alternative to traditional exoskeleton units by being simply designed and supplying an assistive force without the use of; electronics, hydraulics, or pneumatics but by a series of torsion springs couplings or flexible cartridges. Some implementations can include limited mechanical failure during operation and ease of maintenance while being non-invasive to the user and without hindering natural bodily articulation.

Some implementations can include an exoskeletal body support system comprising a yoke; a hip saddle having a hip saddle base, a first hip extension, and a second hip extension; a nested spinal support frame including a first lumbar lever having a first end coupled to the hip saddle, a first lumbar beam having a first end coupled to a second end of the first lumbar lever, a second lumbar lever having a first end coupled to a second end of the first lumbar lever, a second lumbar beam having a first end coupled to a second end of the second lumbar lever; a first leg assembly coupled to the first hip extension of the hip saddle via a first hip joint; and a second leg assembly coupled to the second hip extension of the hip saddle via a second hip joint.

Some implementations can include an additional yoke. In some implementations, the first lumbar lever and the second lumbar lever each have two axes of rotation. In some implementations, the first leg assembly includes an adjustable connection to connect the first leg assembly to the first hip joint.

In some implementations, the first hip joint is connected to the first hip extension at an angle other than a right angle. In some implementations, the second leg assembly includes an adjustable connection to connect the second leg assembly to the second hip joint. In some implementations, the first leg assembly includes an upper leg portion, a knee joint, and a lower leg portion. In some implementations, the upper leg portion of the first leg assembly includes at least one upper leg strap attachment point.

In some implementations, the lower leg portion of the first leg assembly includes at least one lower leg strap attachment point. In some implementations, the second leg assembly includes an upper leg portion, a knee joint, and a lower leg portion. In some implementations, the upper leg portion of the second leg assembly includes at least one upper leg strap attachment point. In some implementations, the lower leg portion of the second leg assembly includes at least one lower leg strap attachment point.

In some implementations, the hip joint includes a flexible chain and a flexible cartridge having a spring section to provide resistance. In some implementations, the spring section includes a plurality of flattened coils. In some implementations, the plurality of flattened coils is arranged in an alternating turn orientation arrangement. In some implementations, each of the plurality of flattened coils are arranged to flex in an edgewise manner relative to the flexing direction of the flexible cartridge.

In some implementations, the knee joint includes a flexible chain and a flexible cartridge disposed within the flexible chain, the flexible cartridge having a spring section to provide resistance. In some implementations, the spring section includes a plurality of flattened coils. In some implementations, the plurality of flattened coils is arranged in an alternating turn orientation arrangement. In some implementations, the plurality of flattened coils is arranged to flex in an edgewise manner relative to the flexing direction of the flexible cartridge.

DETAILED DESCRIPTION

In general, some implementations can provide a solution to help prevent and/or alleviate back, muscle, and joint strain by providing a supportive passive device with applied torsion in the hips and knees for assisted rising from a crouched or bent posture position. An additional nested spinal assembly supports the lumbar and back of the operator.

The torsion can be provided by a flexible cartridge or a compressed wound wire of spring steel with each leg anchored into one of the two adjoining framework members. The machine screw acts as a pivot for the hinge assembly and allows the two framework members to sandwich the spring for optimal torsion. The allowable of elastic deformation and shape retention of the spring with legs anchored to a rigid frame supplements body movement of longitudinal hip rotation from crouched position angle to standing angle and knee extension rotation from bent to standing. When the user initiates a bending movement, a slight resistance will be encountered as the torsion couplings kinetic resistance is stored for the return motion to standing position. The action of bending motion will distort the resting shape of the torsion spring within the couplings causing them to flex while rotating. The same dynamic description applies to the nested spinal framework. As the operator bends forward, the lumbar beams slide past one another with the lumbar lever acting as a double hinge with spring resistance. The pair of lumbar levers between each lumbar beam are fixed to one another by use of a pin allowing comfortable rotation of the operator's back.

The rigid framework includes a parallel support system located on the exterior of the hips, thighs, and calves. Framework is adjustable via a sliding saddle system for variations in hip width. A simple harness is affixed to the padded framework for support on the user's body and to ensure proper placement of joints and fittings during operation.

Some implementations can include calf and thigh mount straps, a padded lumbar strap, belt connection between saddles, sliding saddle system and over-the-shoulder harness. Correct orientation of articulation where rotation pins are facing rearward and do not bind the framework members is imperative to operation and implementation without damaging the mechanical device.

Figure 1:
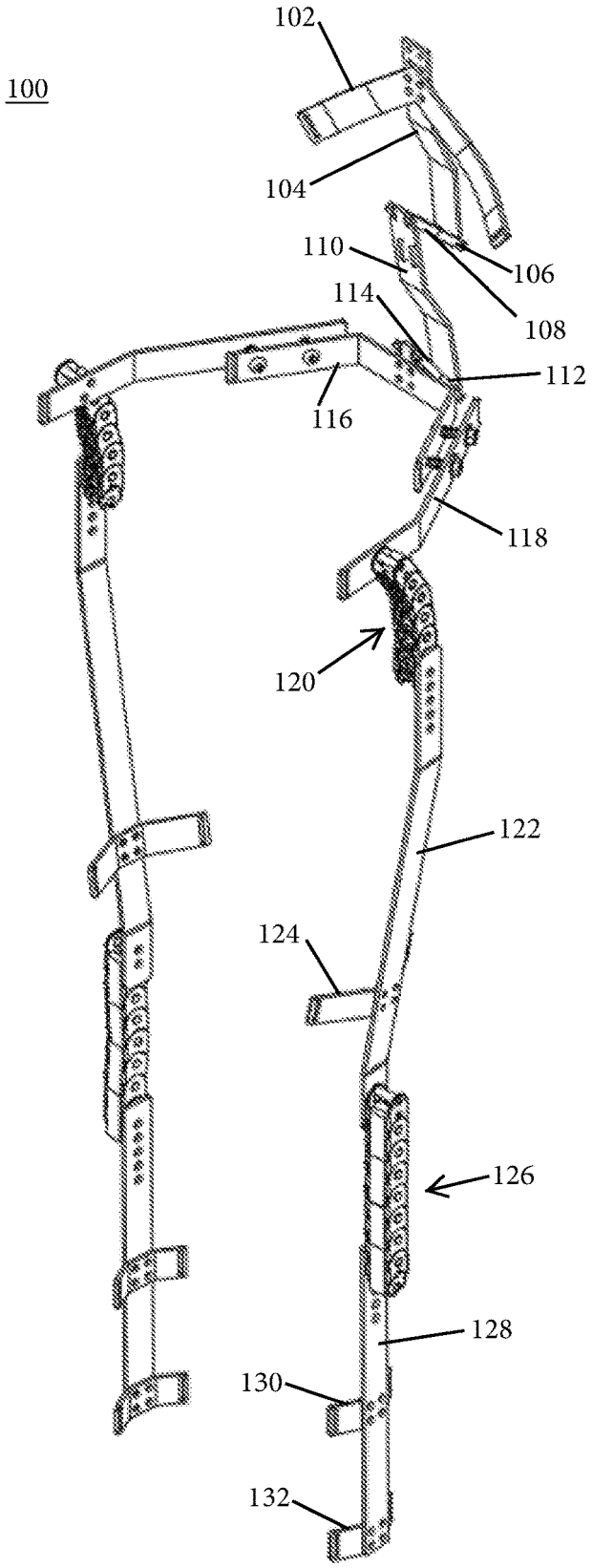
FIG. 1 is a diagram showing a perspective view of an example mechanical support exoskeleton in accordance with some implementations.

FIG. 1 is a diagram showing a perspective view of an example mechanical support exoskeleton 100 in accordance with some implementations. The mechanical support exoskeleton 100 includes one or more yokes 102, a lumbar beam 104, a lumbar lever (106, 108), a lumbar beam 110, and a lumbar lever (112, 114). The mechanical support exoskeleton 100 also includes a hip saddle including a hip saddle base 116 and a right side hip saddle extension coupled to a right hip joint 120, a right upper leg portion 122, an upper leg strap attachment 124, a right knee joint 126, a lower leg portion 128, one or more lower leg strap attachments (130, 132). The left side of the mechanical support exoskeleton 100 has left side equivalents of elements 118-132.

Figure 2:
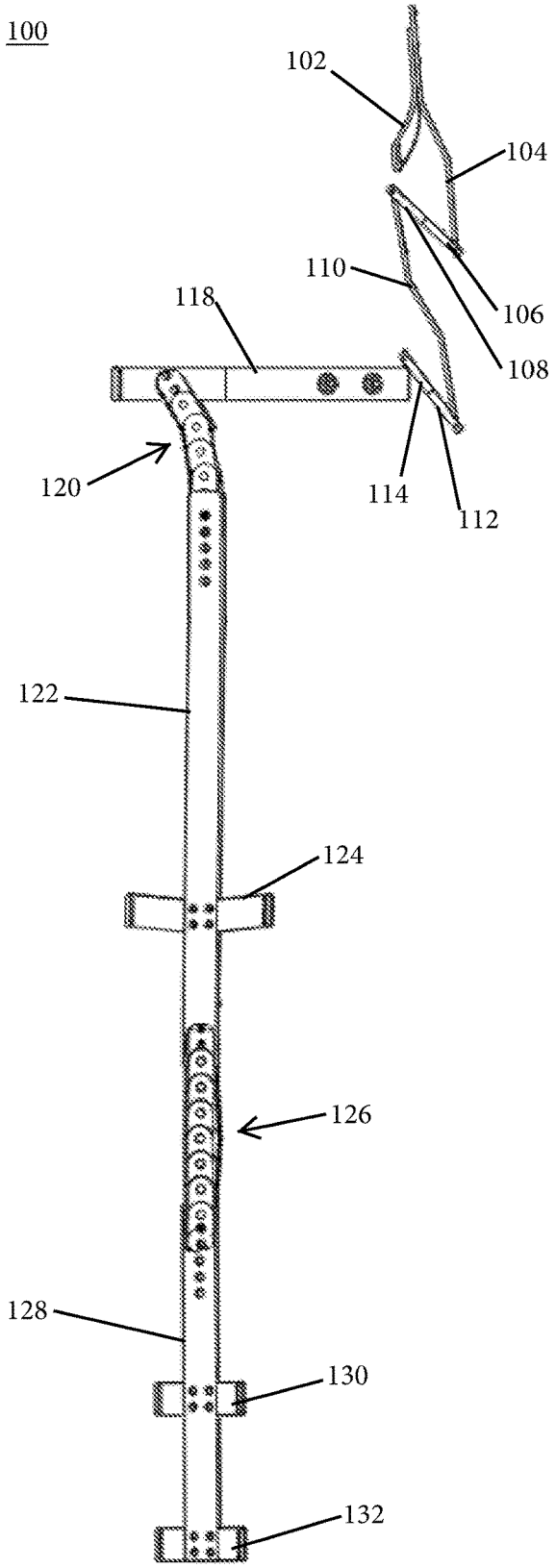
FIG. 2 is a diagram showing a side view of an example mechanical support exoskeleton in accordance with some implementations.

FIG. 2 is a diagram showing a side view of the example mechanical support exoskeleton 100 including components described above in connection with FIG. 1.

Figure 3:
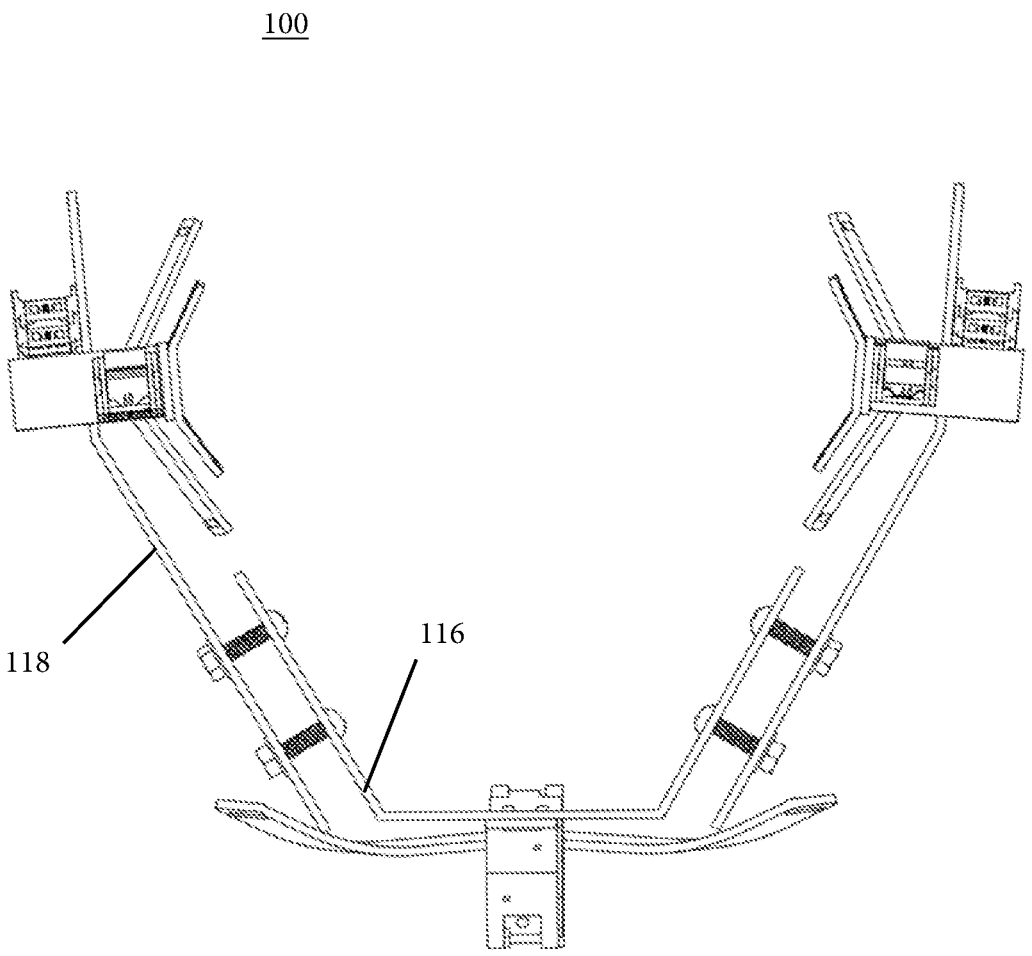
FIG. 3 is a diagram showing a bottom view of an example mechanical support exoskeleton in accordance with some implementations.

FIG. 3 is a diagram showing a bottom view of the example mechanical support exoskeleton 100 showing the hip saddle base 116 and the hip extensions (e.g., 118).

Figure 4:
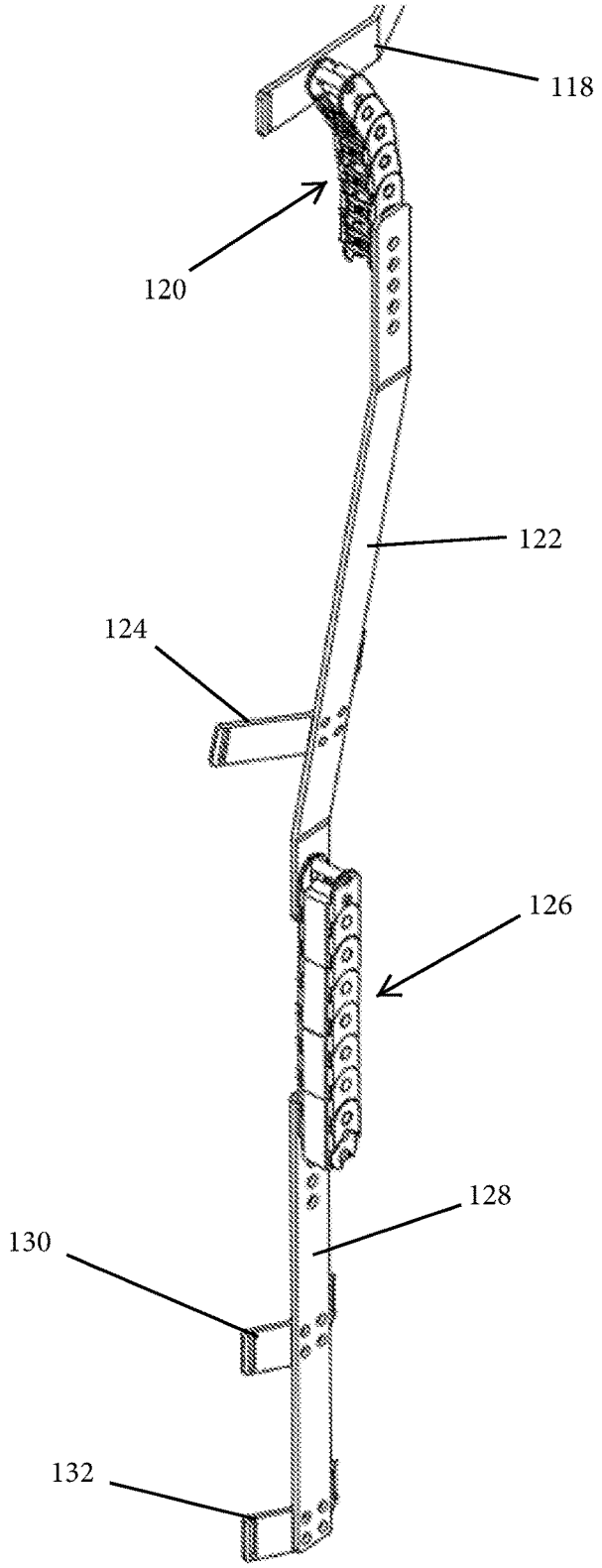
FIG. 4 is a diagram showing detail of a leg section of an example mechanical support exoskeleton in accordance with some implementations.

FIG. 4 is a diagram showing detail of a left leg section of the example mechanical support exoskeleton 100 with elements as described above in connection with FIG. 1.

Figure 5:
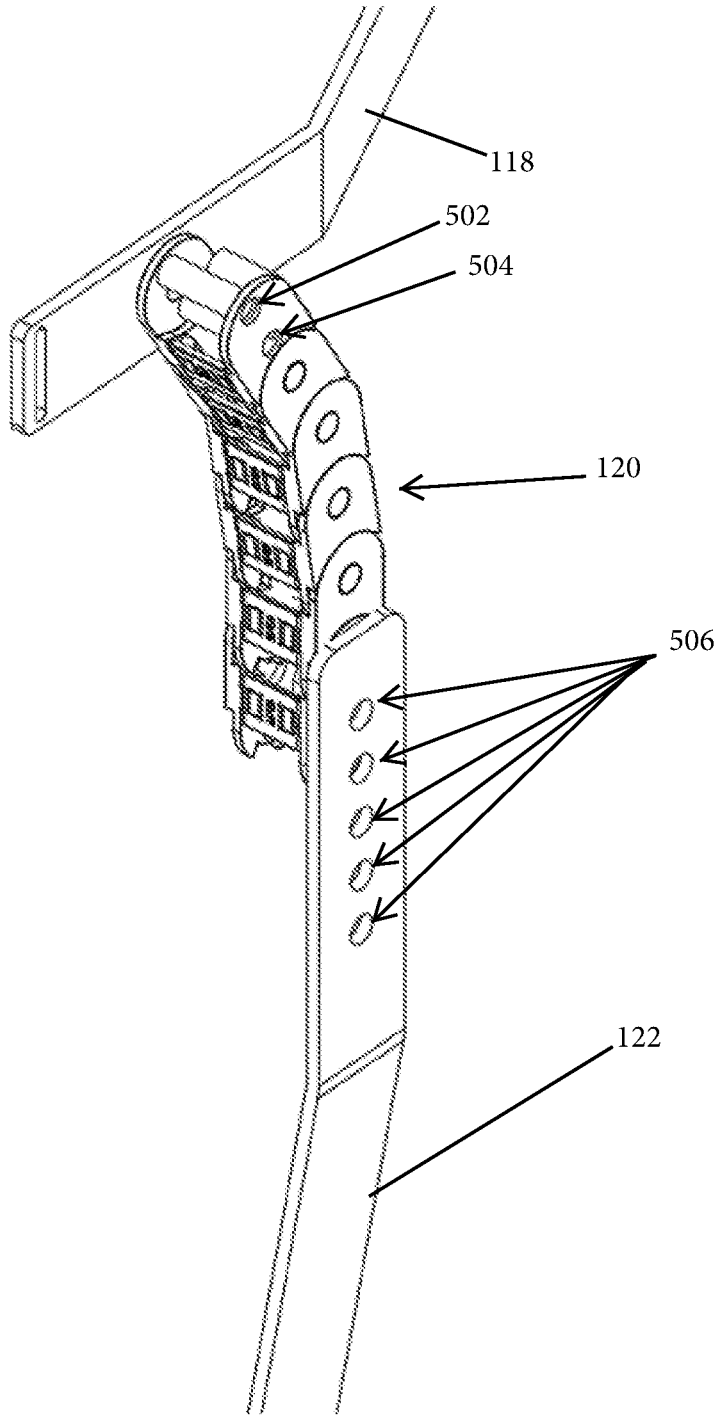
FIG. 5 is a diagram showing detail of an example adjustable joint of an example mechanical support exoskeleton in accordance with some implementations.

FIG. 5 is a diagram showing detail of an example adjustable joint of the example mechanical support exoskeleton 100. In particular, FIG. 5 shows dual angled attachments 502 and 504 to connect the hip joint 120 to the right-side hip saddle extension 118. FIG. 5 also shows the adjustable connection points 506 that can be used to connect the upper leg portion 122 to the hip joint 120 at various settings to account for the height of a user.

Figure 6:
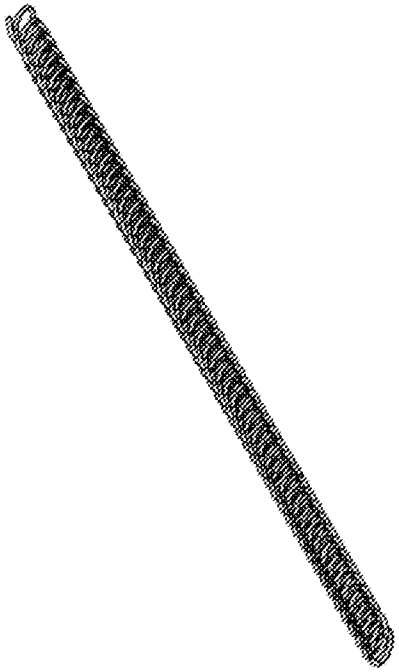
FIG. 6 is a diagram showing an example flattened coil spring in accordance with some implementations.
Figure 7A:
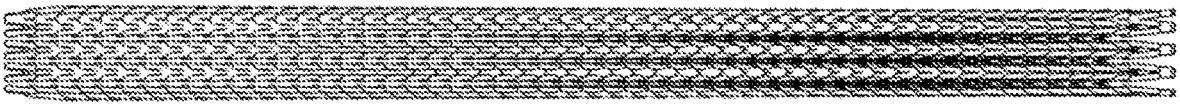
FIGS. 7A and 7B are diagrams showing details of an example flexible cartridge assembly in accordance with some implementations.
Figure 7B:
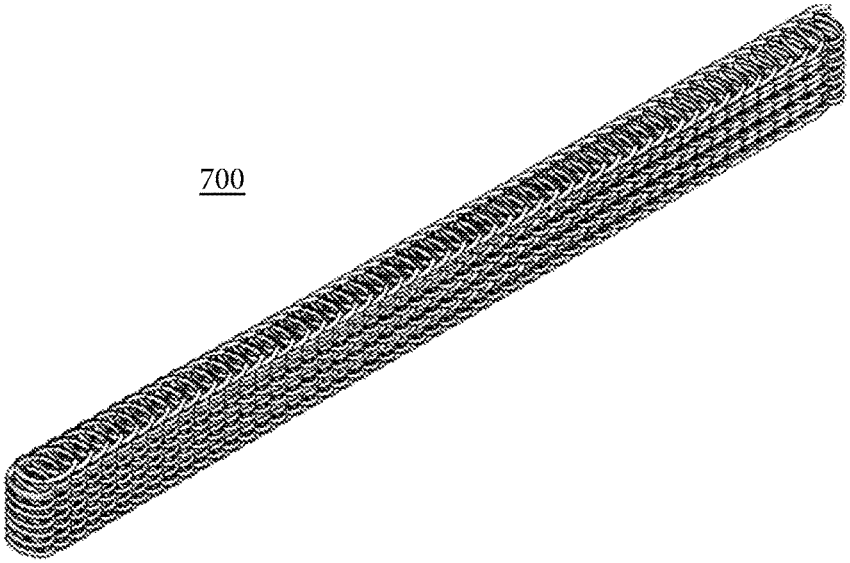

FIG. 6 is a diagram showing an example flattened coil spring in accordance with some implementations. FIGS. 7A and 7B are diagrams showing details of an example flexible cartridge assembly 700 including a plurality of flattened coil springs (e.g., made up of coil springs similar to those shown in FIG. 6). The cartridge 700 can include coils with an alternating coil turn orientation arrangement, which refers to coil winding direction of clockwise and counterclockwise from the starting point of wire. For example, turn orientation is alternating from single point of view, being a pattern of clockwise coil, counterclockwise coil, clockwise coil, etc.

Figure 8:
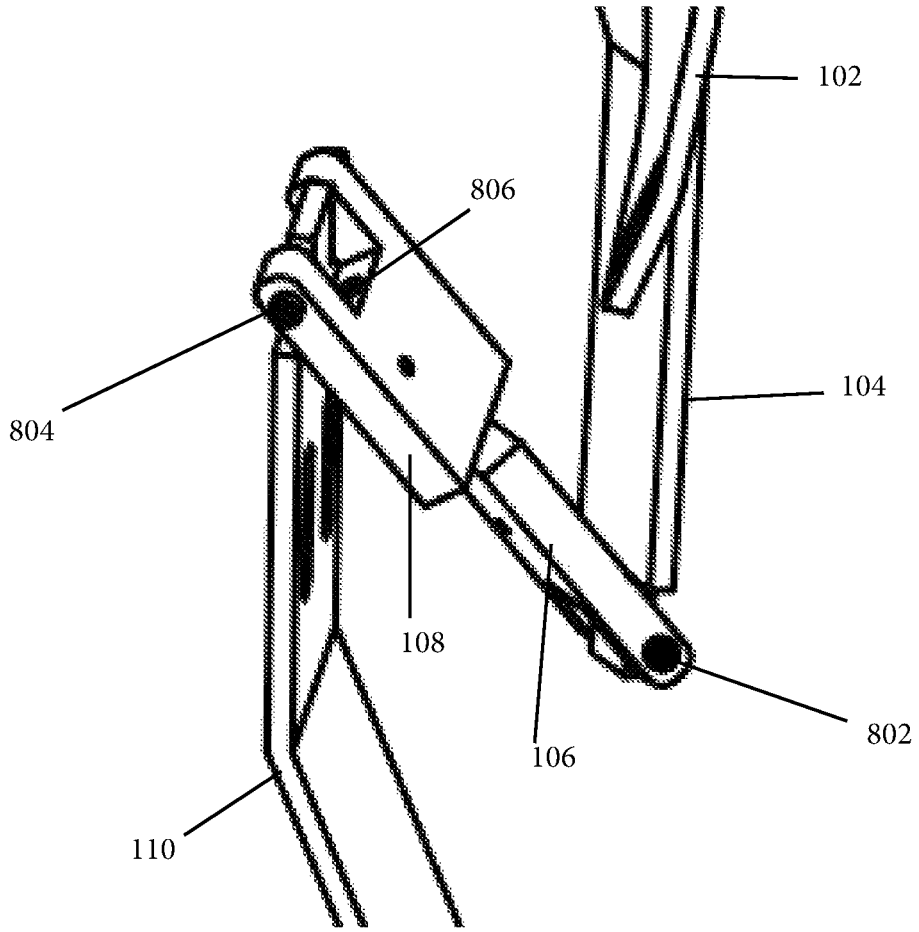
FIG. 8 is a diagram showing details of an example lumbar lever in accordance with some implementations.

FIG. 8 is a diagram showing details of an example lumbar lever (e.g., 106/108) coupled to a lumbar bean 104 and 110. The lumbar lever components 106 and 108 can rotate relative to each other around pivot rod 806 (first axis of rotation) and also pivot about hinges 802 and 804 (second axis of rotation).

Figure 9:
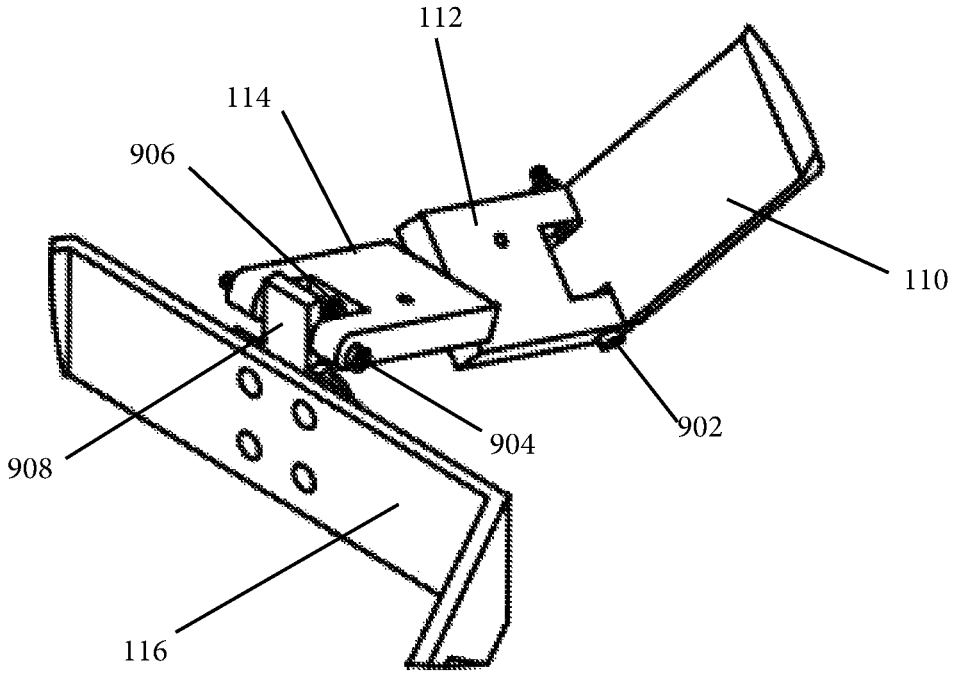
FIG. 9 is a diagram showing details of an example nested spinal support connection to hip saddle in accordance with some implementations.

FIG. 9 is a diagram showing details of an example nested spinal support connection via lumbar lever 112/114 to hip saddle base 116 via pivot rods 902 and 904, and connectors 906 and 908.

Figure 10:
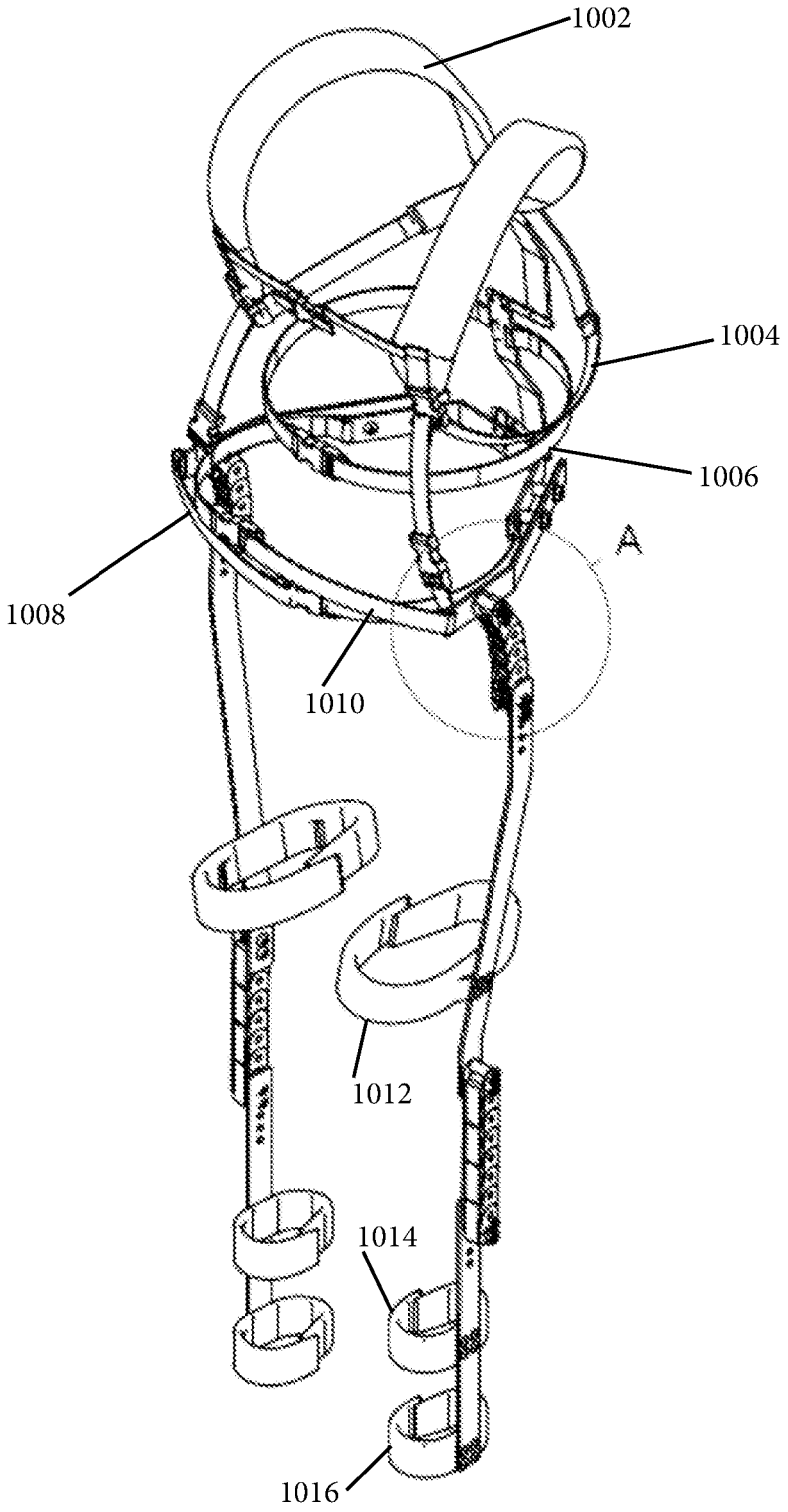
FIG. 10 is a diagram of an example mechanical support exoskeleton with body attachment straps in accordance with some implementations.

FIG. 10 is a diagram of an example mechanical support exoskeleton with body attachment straps 1002, 1004, 1006, 1008, 1010, 1012, 1014, and 1016 in accordance with some implementations.

Figure 11:
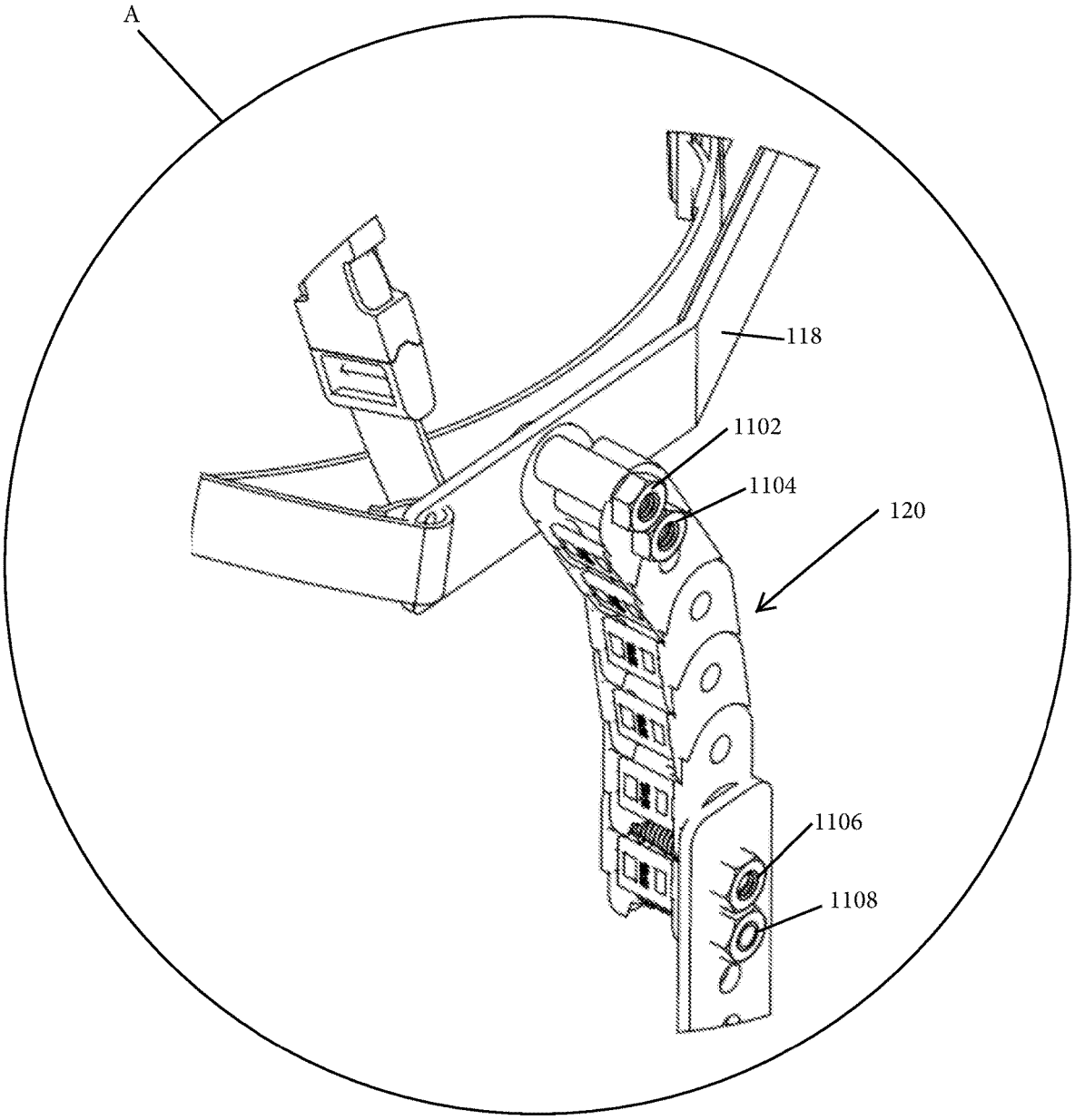
FIG. 11 is a diagram showing details of a hip joint in accordance with some implementations.

FIG. 11 is a diagram showing details of a hip joint showing fasteners 1102 and 1104 used to fasten the hip joint 120 to the hip saddle extension 118. And fasteners 1106 and 1108 used to attach the hip joint 120 to the right-side upper leg portion.

Figure 12:
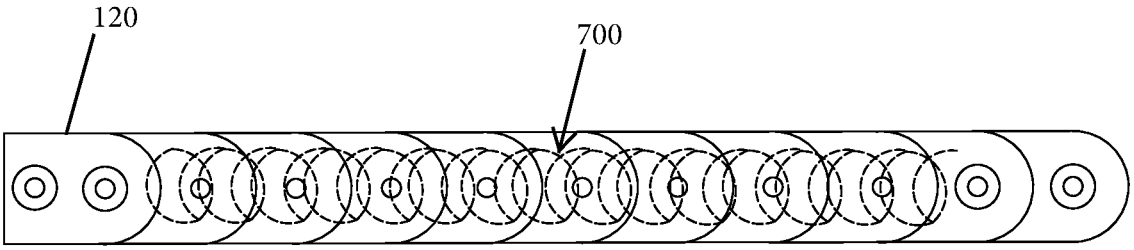
FIG. 12 is a diagram showing details of a flexible cartridge in accordance with some implementations.

FIG. 12 is a diagram showing details of a flexible joint (e.g., hip 120 or knee 126 flexible joint) including a flexible chain and a flexible cartridge (e.g., 700).

Some implementations can include sensors or other electronic elements in the nested spinal support frame, hip joint(s), and/or knee joint(s). The sensors can sense strain, force, weight, range of motion, etc. to help monitor a user for safety compliance or for athletic training or the like. Some implementations can include indicators built into the exoskeletal body support system. In some implementations, data form the sensors can be stored onboard the exoskeletal body support systems or transmitted to another system for analysis.

Some implementations can include exoskeleton support without electronics, hydraulics, or pneumatics. Some implementations can include torsion spring couplings elastically deform but favor rest position inducing a return force when frame is bent into any other natural position. Lumbar and posture support. Invention provides assistive force from naturally bent to standing position.

It is, therefore, apparent that there is provided in accordance with the presently disclosed subject matter, a mechanical exoskeleton. While this disclosed subject matter has been described in conjunction with a number of embodiments, it is evident that many alternatives, modifications and variations would be or are apparent to those of ordinary skill in the applicable arts. Accordingly, applicant intends to embrace all such alternatives, modifications, equivalents and variations that are within the spirit and scope of the disclosed subject matter.

What is claimed is:

1. An exoskeletal body support system comprising:

a yoke;

a hip saddle having a hip saddle base, a first hip extension, and a second hip extension;

a nested spinal support frame including a first lumbar lever having a first end coupled to the hip saddle, a first lumbar beam having a first end coupled to a second end of the first lumbar lever, a second lumbar lever having a first end coupled to a second end of the first lumbar beam, a second lumbar beam having a first end coupled to a second end of the second lumbar lever;

a first leg assembly coupled to the first hip extension of the hip saddle via a first hip joint; and a second leg assembly coupled to the second hip extension of the hip saddle via a second hip joint.

2. The exoskeletal body support system of claim 1, further comprising an additional yoke.

3. The exoskeletal body support system of claim 1, wherein each of the first lumbar lever and the second lumbar lever has two axes of rotation.

4. The exoskeletal body support system of claim 1, wherein the first leg assembly includes an adjustable connection to connect the first leg assembly to the first hip joint.

5. The exoskeletal body support system of claim 1, wherein the first hip joint is connected to the first hip extension at an angle other than a right angle.

6. The exoskeletal body support system of claim 1, wherein the second leg assembly includes an adjustable connection to connect the second leg assembly to the second hip joint.

7. The exoskeletal body support system of claim 1, wherein the first leg assembly includes an upper leg portion, a knee joint, and a lower leg portion.

8. The exoskeletal body support system of claim 7, wherein the upper leg portion of the first leg assembly includes at least one upper leg strap attachment point.

9. The exoskeletal body support system of claim 7, wherein the lower leg portion of the first leg assembly includes at least one lower leg strap attachment point.

10. The exoskeletal body support system of claim 1, wherein the second leg assembly includes an upper leg portion, a knee joint, and a lower leg portion.

11. The exoskeletal body support system of claim 10, wherein the upper leg portion of the second leg assembly includes at least one upper leg strap attachment point.

12. The exoskeletal body support system of claim 10, wherein the lower leg portion of the second leg assembly includes at least one lower leg strap attachment point.

13. The exoskeletal body support system of claim 10, wherein the knee joint includes a flexible chain and a flexible cartridge disposed within the flexible chain, the flexible cartridge having a spring section to provide resistance.

14. The exoskeletal body support system of claim 13, wherein the spring section includes a plurality of flattened coils.

15. The exoskeletal body support system of claim 14, wherein the plurality of flattened coils is arranged in an alternating turn orientation arrangement.

16. The exoskeletal body support system of claim 14, wherein the plurality of flattened coils is arranged to flex in an edgewise manner relative to a flexing direction of the flexible cartridge.

17. The exoskeletal body support system of claim 1, wherein each of the first and second hip joints includes a flexible chain and a flexible cartridge having a spring section to provide resistance.

18. The exoskeletal body support system of claim 17, wherein the spring section includes a plurality of flattened coils.

19. The exoskeletal body support system of claim 18, wherein each of the plurality of flattened coils are arranged in an alternating turn orientation arrangement.

20. The exoskeletal body support system of claim 18, wherein each of the plurality of flattened coils are arranged to flex in an edgewise manner relative to a flexing direction of the flexible cartridge.

* * * * *